US007758370B1

(12) United States Patent
Flaherty

(10) Patent No.: US 7,758,370 B1
(45) Date of Patent: Jul. 20, 2010

(54) QUICK RELEASE ELECTRICAL CONNECTOR

(75) Inventor: Thomas E. Flaherty, Surprise, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/492,386

(22) Filed: Jun. 26, 2009

(51) Int. Cl.
*H01R 13/627* (2006.01)

(52) U.S. Cl. ..... 439/352; 439/578

(58) Field of Classification Search ..... 439/352, 439/353, 578
See application file for complete search history.

(56) References Cited

U.S. PATENT DOCUMENTS

| | | | | |
|---|---|---|---|---|
| 459,951 | A * | 9/1891 | Warner | 285/87 |
| 3,206,540 | A * | 9/1965 | Cohen | 174/89 |
| 3,937,547 | A * | 2/1976 | Lee-Kemp | 439/352 |
| 4,017,139 | A | 4/1977 | Nelson | 339/91 R |
| 4,056,043 | A * | 11/1977 | Sriramamurty et al. | 92/13.2 |
| 4,174,875 | A * | 11/1979 | Wilson et al. | 439/349 |
| 4,412,717 | A | 11/1983 | Monroe | 339/177 R |
| 4,545,633 | A * | 10/1985 | McGeary | 439/141 |
| 4,747,656 | A * | 5/1988 | Miyahara et al. | 385/75 |
| 4,836,580 | A * | 6/1989 | Farrell | 285/24 |
| 4,881,912 | A | 11/1989 | Thommen et al. | 439/585 |
| 5,316,494 | A * | 5/1994 | Flanagan et al. | 439/352 |
| 5,746,619 | A | 5/1998 | Harting et al. | 439/352 |
| 5,954,708 | A | 9/1999 | Lopez et al. | 604/533 |
| 6,036,540 | A | 3/2000 | Beloritsky | 439/582 |
| 6,062,607 | A | 5/2000 | Bartholomew | 285/93 |
| 6,199,913 | B1 * | 3/2001 | Wang | 285/24 |
| 6,199,920 | B1 * | 3/2001 | Neustadtl | 285/322 |
| 6,361,348 | B1 * | 3/2002 | Hall et al. | 439/352 |
| 6,409,534 | B1 | 6/2002 | Weisz-Margulescu | 439/367 |
| 6,422,884 | B1 * | 7/2002 | Babasick et al. | 439/222 |
| 6,450,829 | B1 | 9/2002 | Weisz-Margulescu | 439/352 |
| 6,454,463 | B1 * | 9/2002 | Halbach et al. | 385/60 |
| 6,464,526 | B1 * | 10/2002 | Seufert et al. | 439/352 |
| 6,467,816 | B1 * | 10/2002 | Huang | 285/316 |
| 6,663,397 | B1 | 12/2003 | Lin et al. | 439/63 |
| 6,695,636 | B2 * | 2/2004 | Hall et al. | 439/352 |
| 6,793,528 | B2 | 9/2004 | Lin et al. | 439/582 |
| 6,942,516 | B2 * | 9/2005 | Shimoyama et al. | 439/352 |
| 6,942,520 | B2 * | 9/2005 | Barlian et al. | 439/548 |
| 6,945,805 | B1 * | 9/2005 | Bollinger | 439/348 |
| 6,955,563 | B1 | 10/2005 | Croan | 439/578 |
| 7,090,525 | B1 * | 8/2006 | Morana | 439/352 |
| 7,140,645 | B2 * | 11/2006 | Cronley | 285/34 |
| 7,238,047 | B2 * | 7/2007 | Saettele et al. | 439/578 |
| 7,291,033 | B2 | 11/2007 | Hu | 439/347 |
| 7,318,609 | B2 * | 1/2008 | Naito et al. | 285/322 |
| 7,322,846 | B2 * | 1/2008 | Camelio | 439/352 |
| 7,329,139 | B2 * | 2/2008 | Benham | 439/352 |
| 7,335,058 | B1 | 2/2008 | Burris et al. | 439/578 |
| 7,347,727 | B2 * | 3/2008 | Wlos et al. | 439/578 |

(Continued)

*Primary Examiner*—T C Patel
*Assistant Examiner*—Vladimir Imas
(74) *Attorney, Agent, or Firm*—Matthew J. Mason

(57) ABSTRACT

The electrical connector has a tubular sleeve and an outer tubular housing disposed over the tubular sleeve with at least two openings in the outer tubular housing to receive projections from the tubular sleeve. A resilient member biases the tubular sleeve and outer tubular housing relative to one another. Moving the outer tubular housing relative to the tubular sleeve pushes the projections radially inward to release the electrical connector. In an alternative embodiment, moving the outer tubular housing pulls the projections radially outward releasing the electrical connector.

10 Claims, 10 Drawing Sheets

U.S. PATENT DOCUMENTS

| | | | | |
|---|---|---|---|---|
| 7,351,088 | B1 * | 4/2008 | Qu | 439/352 |
| 7,387,524 | B2 * | 6/2008 | Cheng | 439/352 |
| 7,396,249 | B2 | 7/2008 | Kauffman | 439/349 |
| 7,513,788 | B2 * | 4/2009 | Camelio | 439/352 |
| 7,568,945 | B2 * | 8/2009 | Chee et al. | 439/578 |
| 7,578,693 | B2 * | 8/2009 | Yoshida et al. | 439/352 |
| 7,588,454 | B2 * | 9/2009 | Nakata et al. | 439/357 |
| 7,625,227 | B1 * | 12/2009 | Henderson et al. | 439/350 |
| 2001/0046802 | A1 * | 11/2001 | Perry et al. | 439/352 |
| 2002/0019161 | A1 * | 2/2002 | Finke et al. | 439/352 |
| 2003/0139081 | A1 * | 7/2003 | Hall et al. | 439/352 |
| 2006/0223355 | A1 * | 10/2006 | Hirschmann | 439/352 |
| 2007/0054535 | A1 * | 3/2007 | Hall et al. | 439/352 |
| 2007/0059968 | A1 * | 3/2007 | Ohtaka et al. | 439/352 |
| 2007/0082533 | A1 * | 4/2007 | Currier et al. | 439/352 |
| 2007/0087613 | A1 * | 4/2007 | Schumacher et al. | 439/352 |
| 2007/0173100 | A1 * | 7/2007 | Benham | 439/352 |
| 2007/0232117 | A1 * | 10/2007 | Singer | 439/352 |
| 2008/0214040 | A1 * | 9/2008 | Holterhoff et al. | 439/352 |

* cited by examiner

QUICK RELEASE ELECTRICAL CONNECTOR

BACKGROUND OF THE INVENTION

1. Field of the Invention

The present invention relates generally to quick release electrical connectors, and particularly to microwave frequency coaxial connectors having a push-on interface with quick release.

2. Technical Background

Within the technical field of microwave coaxial connectors there exists a sub-set of connector interface designs engageable without the aid of external coupling mechanisms such as internally threaded rings and externally threaded components. These interfaces are known in the industry as push-on interconnects. Coaxial push-on interconnects are used to attach printed circuit boards, coaxial cables or modules to another object such as a corresponding connector or an appliance or junction having a terminal, or port, adapted to engage the connector.

Typically, existing push-on connectors utilize a coupling system that includes a female with spring fingers and a corresponding male port configured to receive the female connector without the use of a coupling nut. Due to various application and environmental factors, such as mass, vibration and relative motion of equipment, these interconnects can disengage, or partially disengage, thereby creating potentially dangerous reliability issues.

Previous attempts to provide a reliable and stable connection have addressed this issue to some degree. However, these arrangements have not proven to be entirely satisfactory. Some of the devices currently utilize an internal annular groove in the male connector known as a detent ring. This detent ring is typically located within the male housing to retain the mating connector. These rings allow for predictable resistance to connector separation but do not positively lock the connectors together.

Other devices known in the industry are often dependent upon an external spring member, either in the form of a coil or a slotted beam configuration, which necessitates additional components and a larger frame to accommodate such hardware. Additionally, some of the aforementioned interconnect systems require special tools for mating and separation of connector interfaces.

It would be desirable therefore to provide an electrical connector that can be used without the use of tools, is unmated only when desired and is unmated with minimal force.

SUMMARY OF THE INVENTION

Disclosed herein is electrical connector for mounting on an end of a coaxial cable that includes a tubular sleeve configured to be mounted to a coaxial cable, the tubular sleeve including a front end, a back end, and a middle portion, at least two spring fingers extending between the front end and the middle portion and having outwardly extending projections at the front end thereof; and a forward facing shoulder disposed between the back end and the middle portion, an outer tubular housing slidingly disposed over the tubular sleeve, the outer tubular housing having a first distal portion having a first diameter and a second proximal portion having a second diameter, the first diameter being smaller than the second diameter, the outer tubular housing extending beyond the front end of the tubular sleeve, at least two openings disposed in the first distal portion to receive the projections from the at least two spring fingers, the at least two openings disposed a predetermined distance from a front end thereof, and a resilient member disposed around the tubular sleeve, a first portion engaging the forward facing shoulder and a second portion engaging a rearward facing surface on an interior surface of the outer tubular housing to bias the outer tubular housing in a forward direction relative to the tubular sleeve.

In some embodiments, the front end of the tubular sleeve is rearward of the front end of the outer tubular housing when the outer sleeve is biased in a forward position.

In some embodiments, a washer is disposed between the resilient member and the rearward facing surface on the interior surface of the outer tubular housing.

In other embodiments, the connector includes a center contact and a dielectric disposed around the center contact, the center contact and dielectric being disposed in the tubular sleeve and a front end of the center contact extends forward of the outer tubular housing.

In another aspect, an electrical connector is disclosed that includes a first connector portion that includes an inner tubular sleeve having a distal portion, a medial portion, and a proximal portion, the distal portion having at least two segmented elements, the at least two segmented elements each having a projection extending radially inward and having a rearward facing surface, the medial portion having a forward facing surface on an interior portion of the inner tubular sleeve and a rearward facing surface on an external portion of the inner tubular sleeve, and an outer tubular sleeve slidingly disposed over the inner tubular sleeve and having a distal portion and a proximal portion, the proximal portion disposed over the proximal portion of the inner tubular sleeve and having a first internal radius, and the distal portion disposed over the distal and medial portions of the inner tubular sleeve and having a second internal radius that is greater than the first internal radius, the distal portion having an inward and backward extending projection at a front end to engage and force the at least two segmented elements radially outward when the outer tubular sleeve is moved rearwardly relative to the inner tubular sleeve, and a second connector portion to be mated with the first connector portion, the second connector portion having a chamfered front portion extending to a rearward facing surface and configured to fit within the distal portion of the inner tubular sleeve, the projections on the at least two segmented elements engaging the rearward facing surface of the second connector portion when mated therewith.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
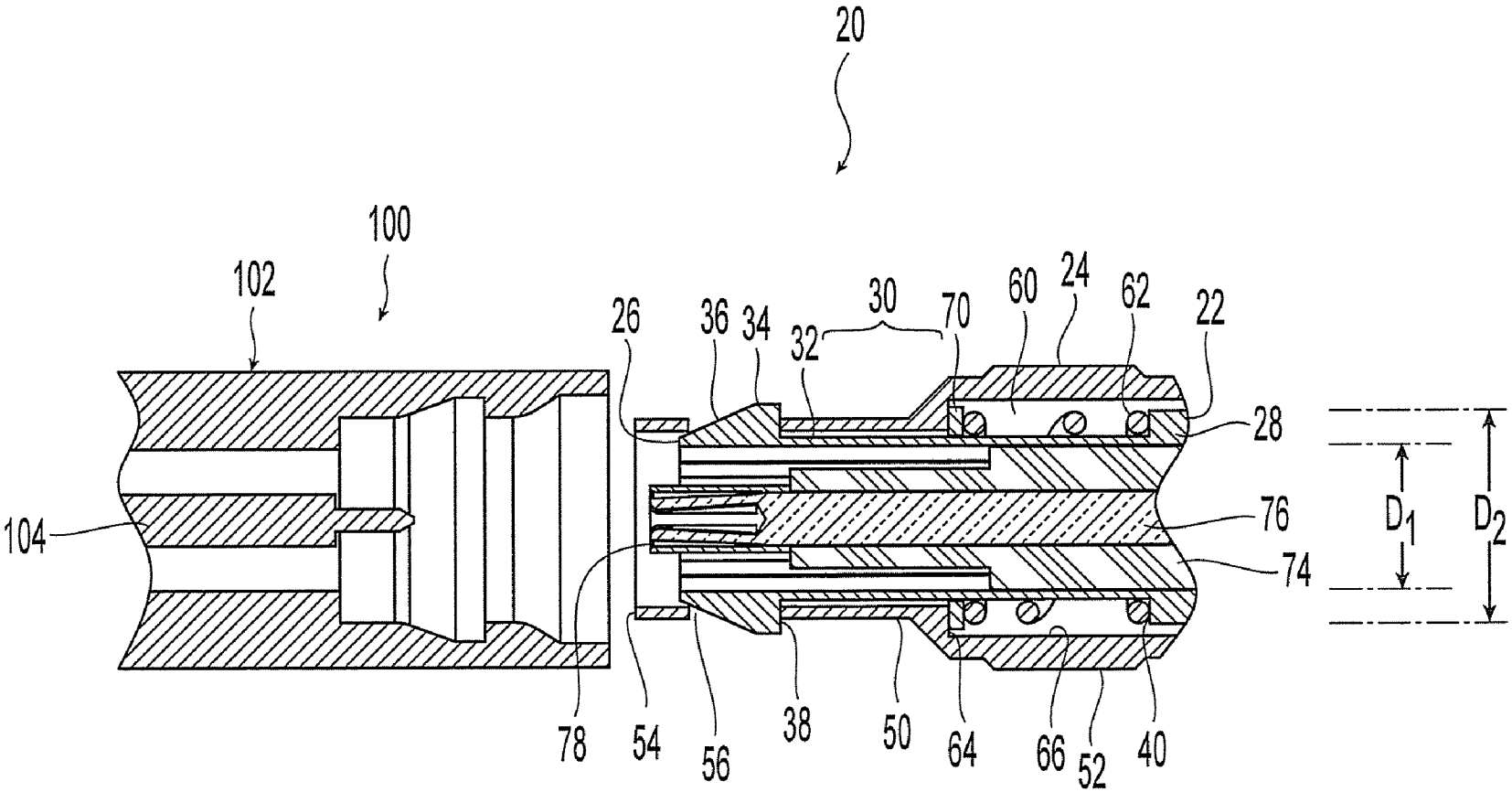
FIG. 1 is a cross sectional view of one embodiment of an electrical connector according to the present invention prior to engagement.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-5, an electrical connector 20 has a tubular sleeve 22 and an outer tubular housing 24 that is slidingly disposed over the tubular sleeve 22. The tubular sleeve 22 has a front end 26, a back end 28 and a middle portion 30, and at least two spring fingers 32 extending between the front end 26 and the middle portion 30. Each of the at least two spring fingers 32 has an outwardly extending projection 34 at the front end. Each of the outwardly extending projections 34 and has a chamfered portion 36 and a rearward facing surface 38. The tubular sleeve 22 also has a forward facing shoulder 40 disposed between the back end 28 and the middle portion 30.

The outer tubular housing 24 is disposed over the tubular sleeve 22 and has a first distal portion 50 having a first diameter D1 and a second proximal portion 52 having a second diameter D2, the first diameter D1 being smaller than the second diameter D2. The outer tubular housing 24, and more particularly, the first distal portion 50, has a front end 54. The first distal portion 50 includes at least two openings 56 to receive the projections 34 therethrough. The number of openings 56 preferably corresponds to the number of projections 34 (and similarly the number of spring fingers 32) on the tubular sleeve 22.

A space 60 is created between the tubular sleeve 22 and the outer tubular housing 24 as a result of the increased diameter D2. A resilient member 62 is disposed in the space 60 and that at one end engages the forward facing shoulder 40 of the tubular sleeve 22 and at the other end of the space 60 engages a rearward facing surface 64 on an interior surface 66 of the outer tubular housing 24. The resilient member 62 is illustrated as a cylindrical spring, but could be any resilient element that biases the outer tubular housing 24 forward on the tubular sleeve 22. As illustrated in FIG. 1, a washer 70 may also be inserted between the rearward facing surface 64 in the resilient number 62 to assist in providing ground contact between connector components.

The tubular sleeve 22 is mounted on a dielectric 74, which in turn is mounted on a center contact 76. The center contact 76 as a front end 78 that is disposed forward of the front end 26 of the tubular sleeve 22 but rearward of the front end 54 of the outer tubular housing 24.

The electrical connector 20 is mated with a male receptacle 100 that has an outer tubular housing 102 and a cylindrical pin 104 configured to mate with the center contact 76 of electrical connector 20.

Figure 2:
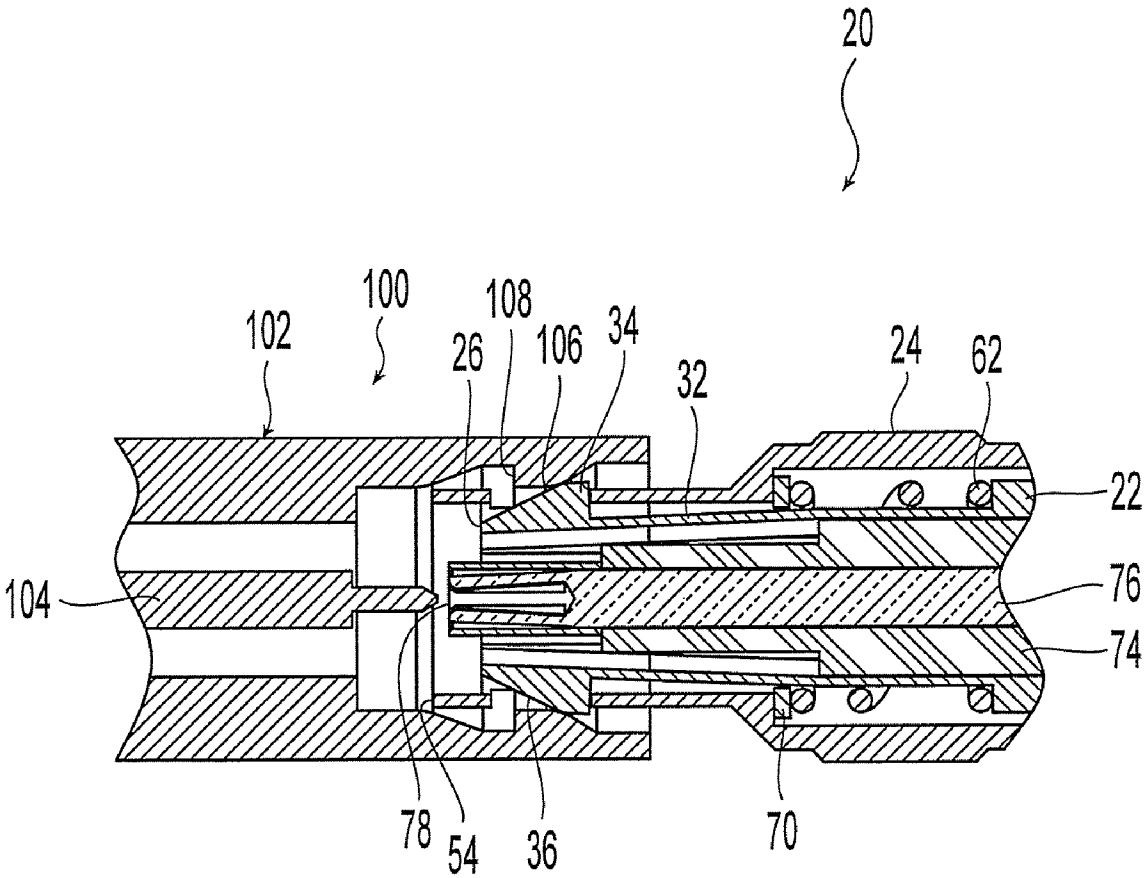
FIG. 2 is a cross sectional view of the electrical connector of FIG. 1 in partial engagement.
Figure 3:
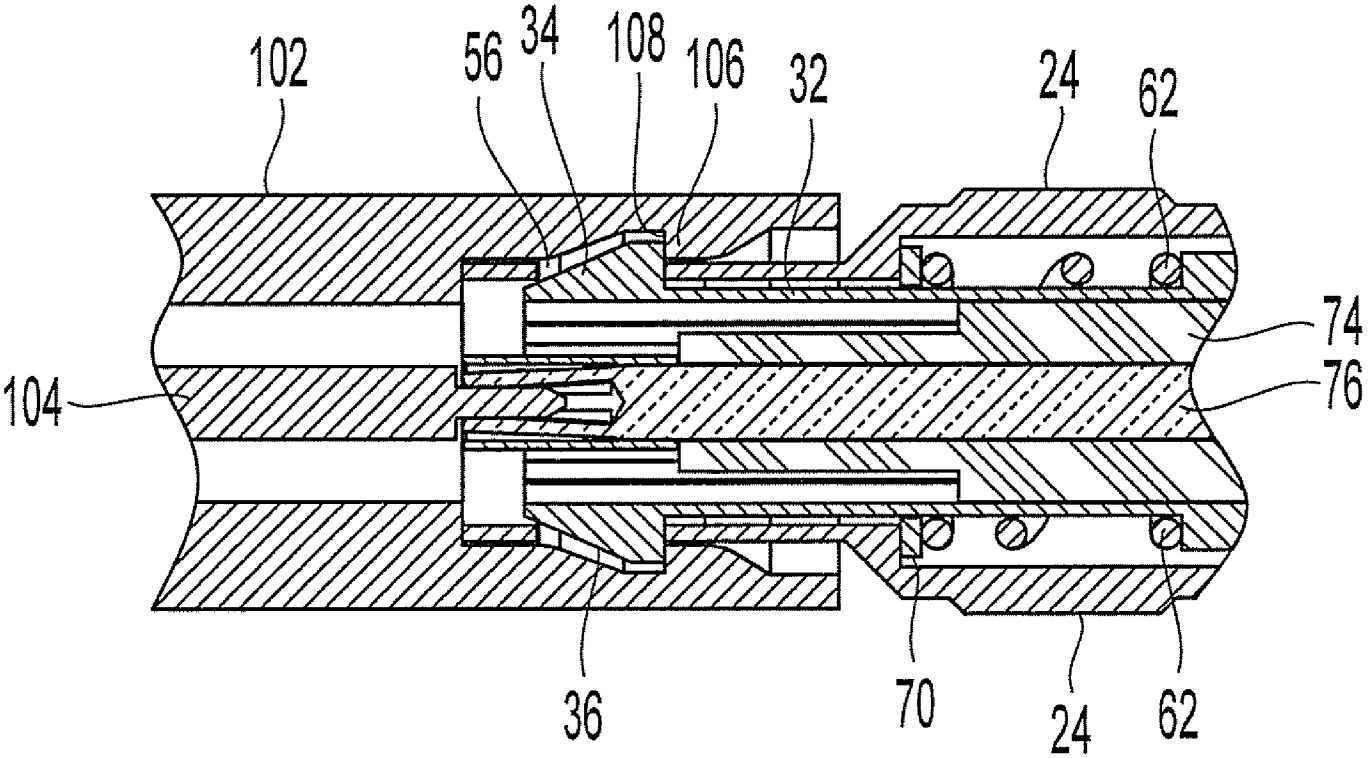
FIG. 3 is a cross sectional view of the electrical connector of FIG. 1 in full engagement.

FIG. 2 illustrates the electrical connector 20 partially inserted into the male receptacle 100. As a user inserts the electrical connector 20 into the male receptacle 100 using the outer tubular housing 24, an annular projection 106 pushes the projections 34 (and the spring fingers 32) radially inward, allowing the electrical connector 20 to be further inserted into the male receptacle 100. As the electrical connector 20 is further inserted into the male receptacle 100, the front end 54 of the outer tubular housing 24 makes contact with the outer tubular housing 102 of the male receptacle 100. The rearward facing surface 38 of projections 34 engage a rearward facing surface 108 of annular projection 106, thereby retaining the electrical connector 20 in the male receptacle 100. See FIG. 3.

Figure 4:
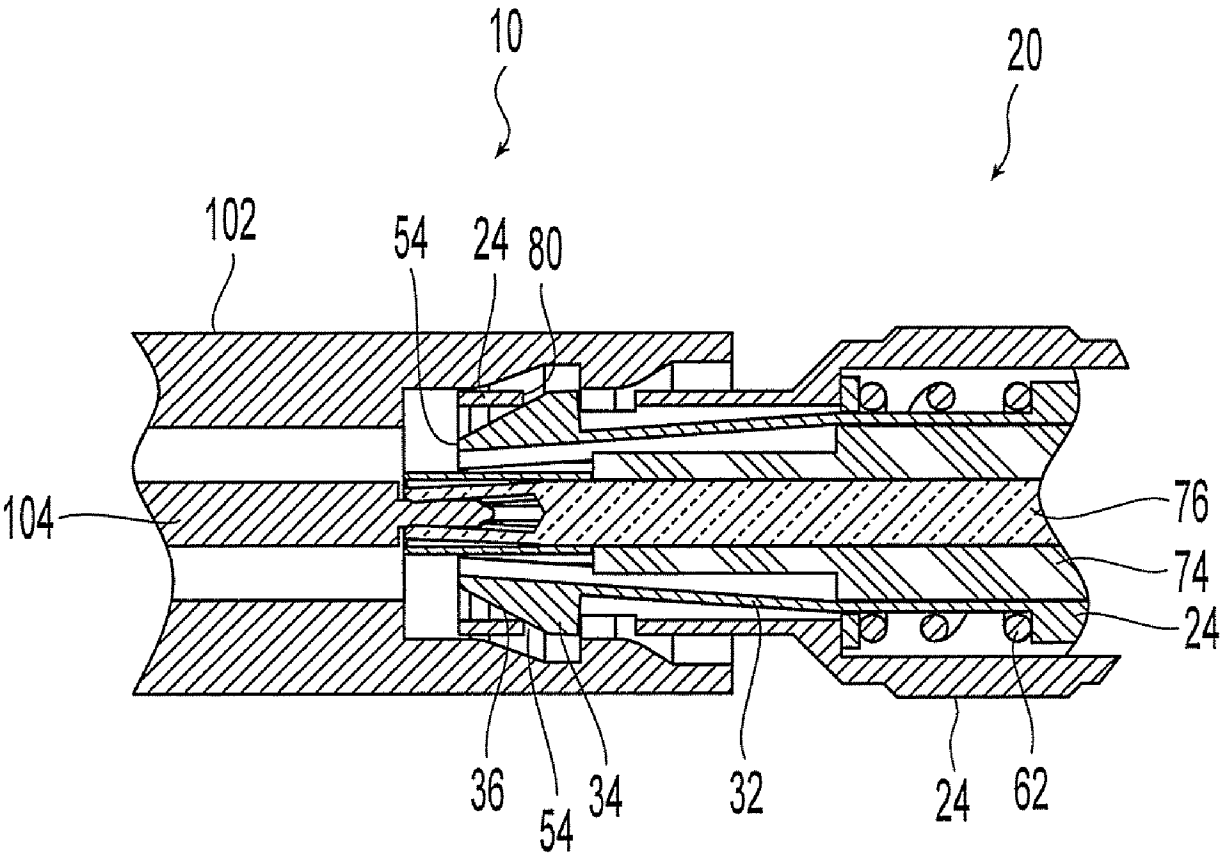
FIG. 4 is a cross sectional view of the electrical connector of FIG. 1 in partial disengagement.

To remove the electrical connector 20 from the male receptacle 100 as illustrated in FIG. 4, a user pulls rearwardly on the outer tubular housing 24. Pulling on the outer tubular housing 24 compresses the resilient member 62 and moves the outer tubular housing 24 rearwardly relative to the tubular sleeve 22. The outer tubular housing 24, and in particular, an edge 80 of the opening 56 engages the chamfered portion 34, which in turn causes the projection 34 to move radially inward and to disengage the rearward facing surface 38 from the rearward facing surface 108 of the annular projection 106, allowing the electrical connector 20 to be removed from the male receptacle 100 with minimal force.

Figure 5:
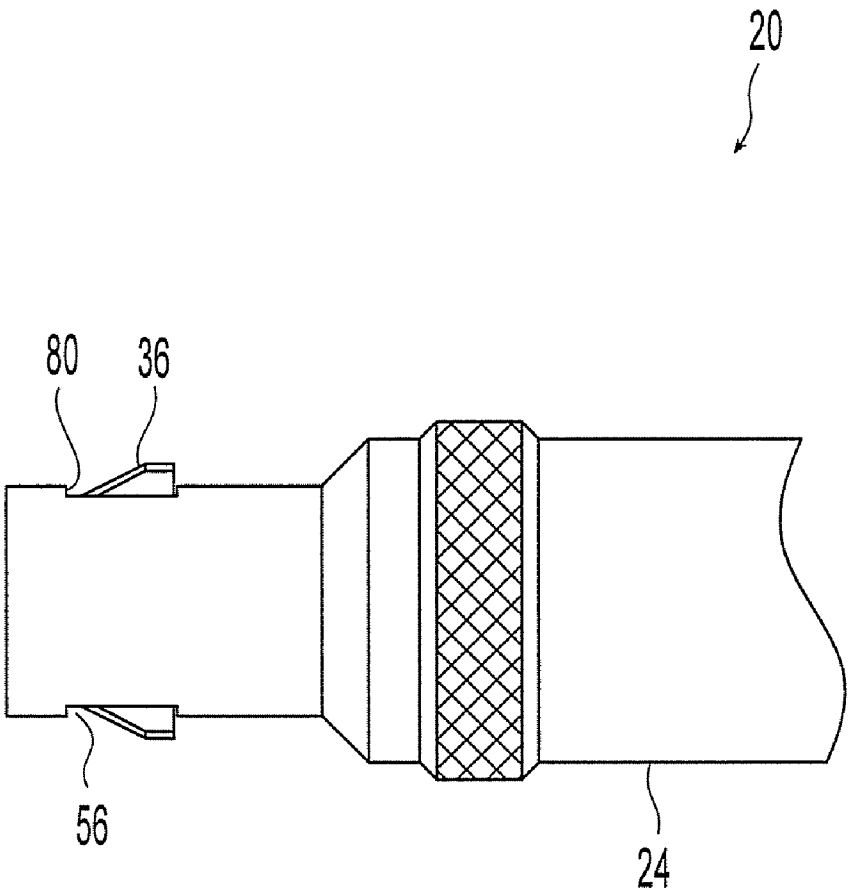
FIG. 5 is an elevational view of the electrical connector of FIG. 1.

An elevational view of electrical connector 20 is illustrated in FIG. 5. The openings 56 are disposed in a distal portion of the outer tubular housing 24. The exact location of the openings 56 depend upon the location of the annular projection 106 and the location of where the front end 54 makes contact with the male connector 100. As such, the location of the openings 56 can be either farther forward or even rearward from where their location is illustrated. However, it should be noted that the front end 26 of the tubular sleeve 22 does not extend beyond the front end 54 of the outer tubular housing 24.

Figure 6:
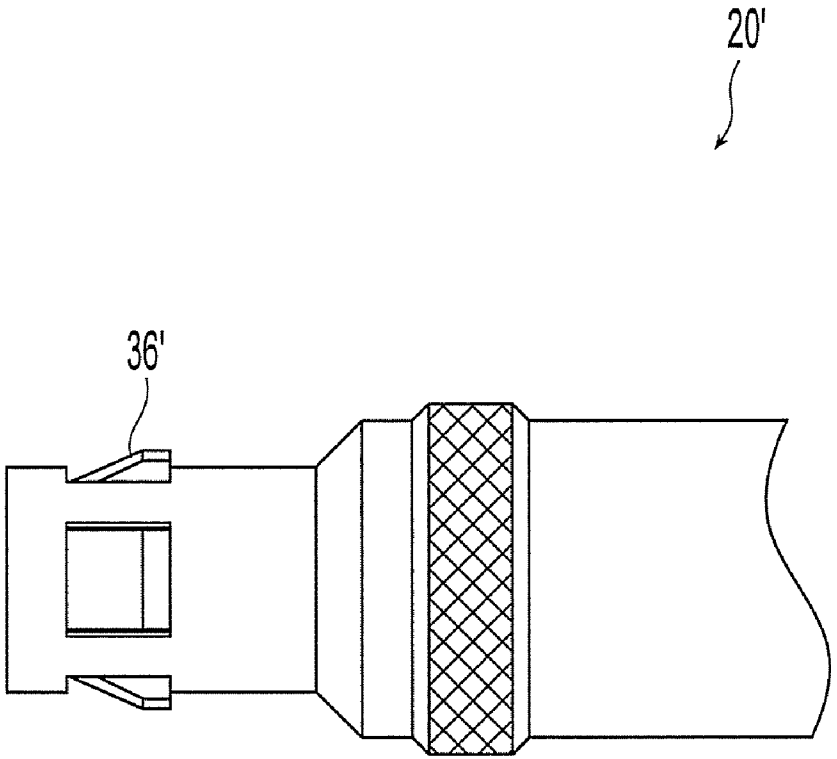
FIG. 6 is an elevational view of another embodiment of an electrical connector according to the present invention.

An alternative embodiment of an electrical connector 20' is illustrated in FIG. 6. Electrical connector 20' is similar to the electrical connector 20 illustrated in the prior figures, but has four spring fingers (not visible) and four projections 34', rather than just two.

Figure 7:
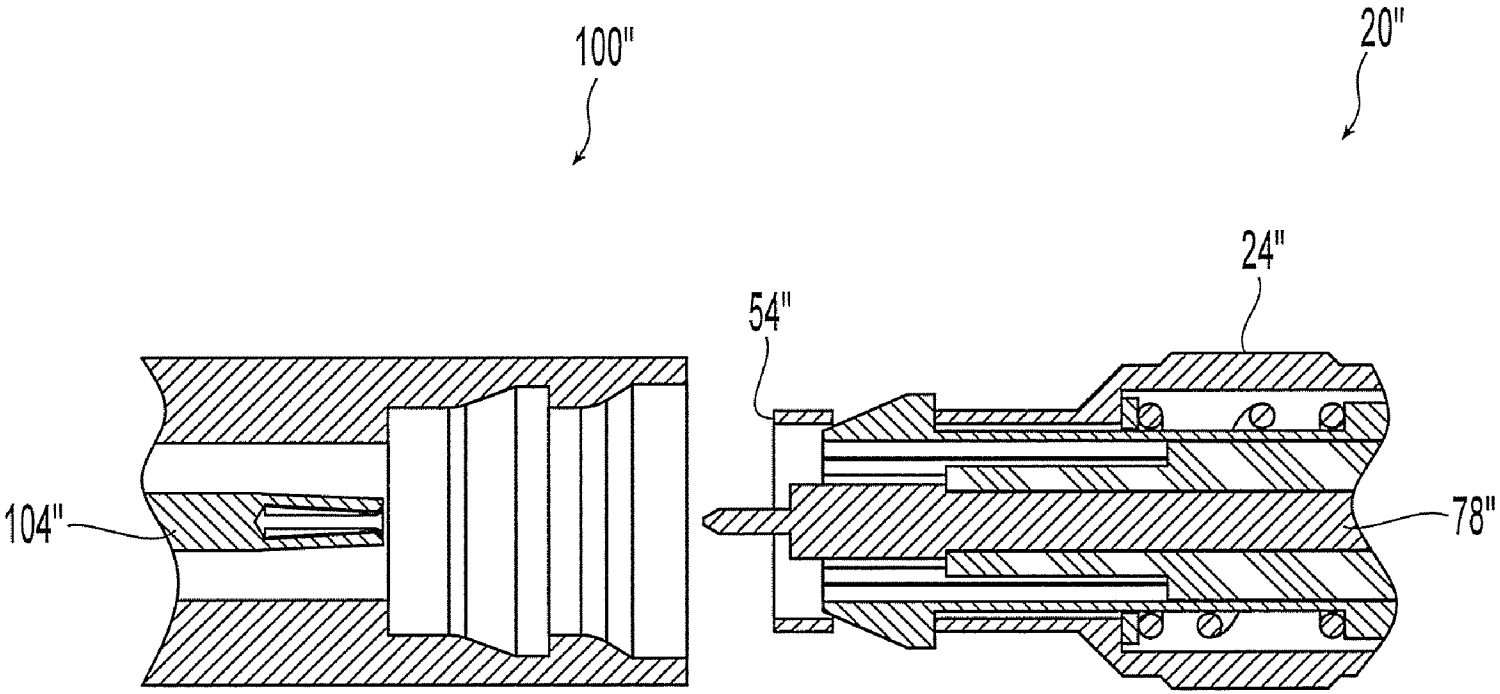
FIG. 7 is a cross sectional view of another embodiment of an electrical connector according to the present invention prior to engagement.

An alternative embodiment of an electrical connector 20" is illustrated in FIG. 7. Electrical connector 20" is similar to the prior electrical connectors, but the electrical contacts have had their configurations reversed in each of the components. For example, the electrical contact 78" now has a male configuration rather than a female configuration and a forward end that extends beyond the forward end 54" of the outer tubular housing 24". Similarly, the center conductor 104" of male receptacle 100" has a female configuration instead.

Figure 8:
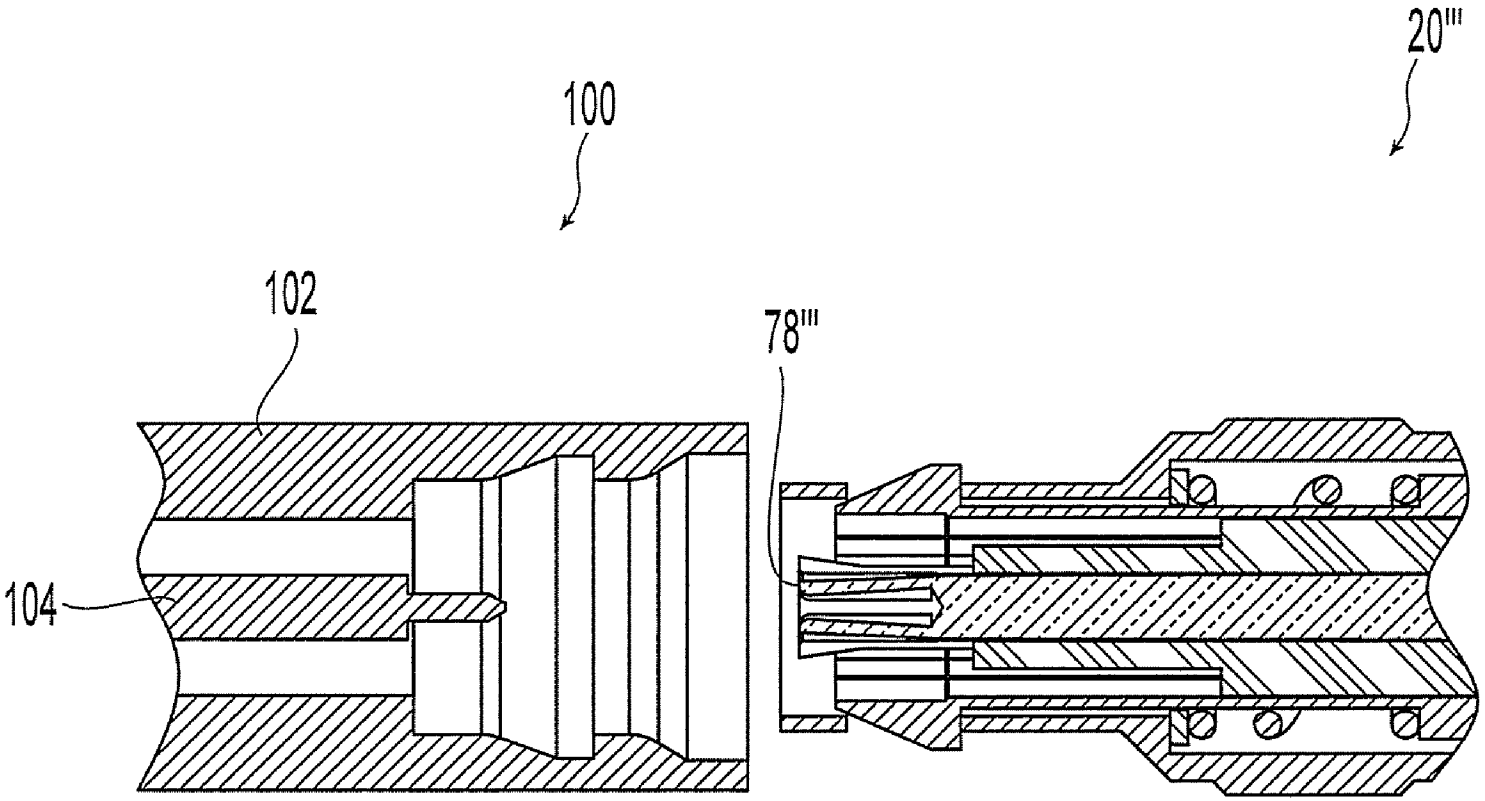
FIG. 8 is a cross sectional view of another embodiment of an electrical connector according to the present invention prior to engagement.

An alternative embodiment of an electrical connector 20'" is illustrated in FIG. 8. Electrical connector 20'" is similar to the prior electrical connectors, but the front end of electrical contact 78'" has been tapered to enhance the performance of the connector.

Figure 9:
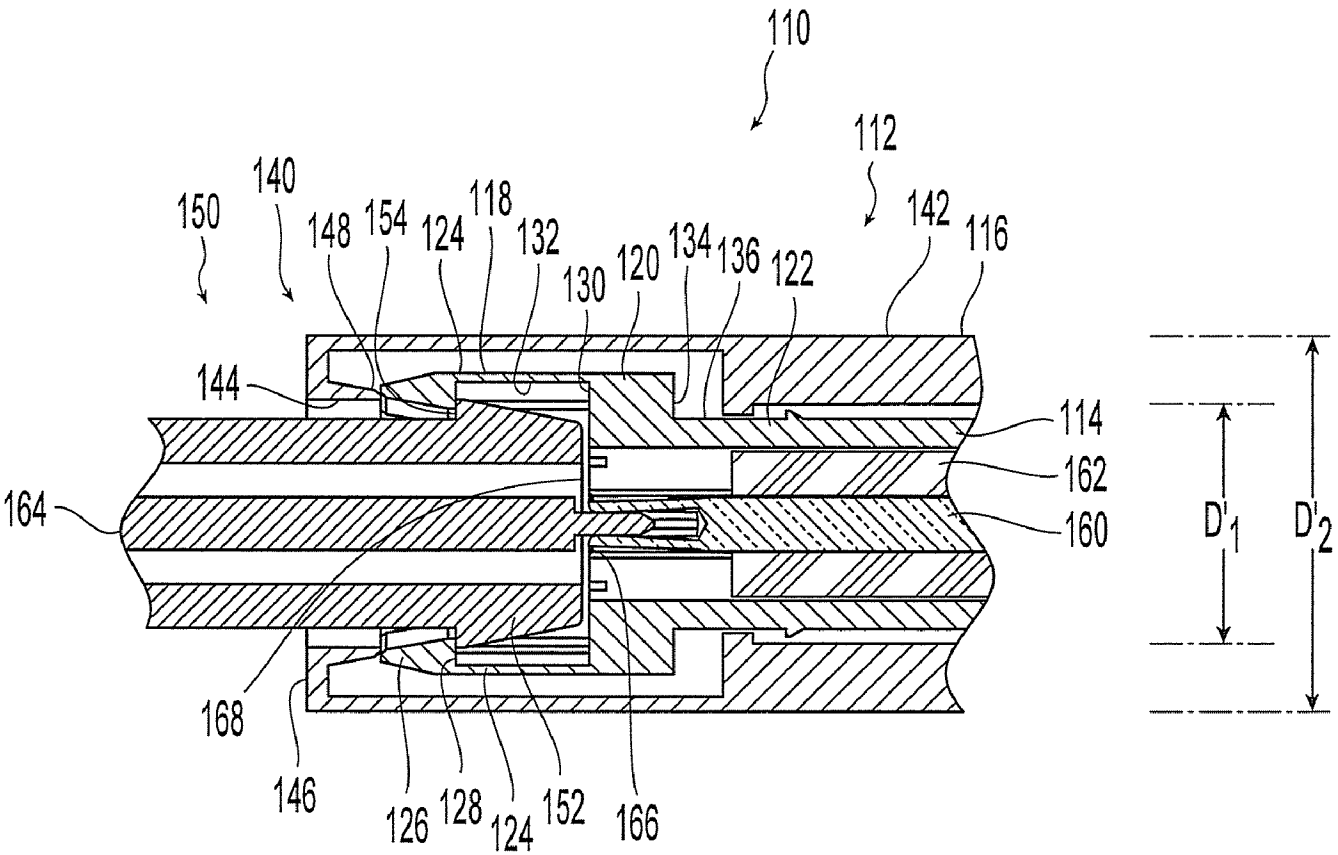
FIG. 9 is a cross sectional view of another embodiment of an electrical connector according to the present invention.

Another embodiment of an electrical connector 110 is illustrated in FIG. 9. The electrical connector 110 has a first connector portion 112 that includes an inner tubular sleeve 114 and an outer tubular sleeve 116 that is slidingly disposed over the inner tubular sleeve 114. The inner tubular sleeve 114 has a distal portion 118, a medial portion 120 and a proximal portion 122. The distal portion has at least two segmented elements 124 and each of the at least two segmented elements 124 has a projection 126 extending radially inward, each projection 126 having a rearward facing surface 128. The medial portion 120 has a forward facing surface 130 on an interior portion 132 of the inner tubular sleeve 114 and a rearward facing surface 134 on an external portion 136 of the inner tubular sleeve 114.

The outer tubular sleeve 116 has a distal portion 140 and a proximal portion 142. The proximal portion 142 is disposed over the proximal portion 122 of the inner tubular sleeve 114 and has an internal diameter D'1. The distal portion 140 is disposed over both the distal and medial portions 118, 120 and has a second internal diameter D'2. The distal portion 140 has an inward and backward extending projection 144 at a front end 146 of the distal portion 140 to engage and force the at least two segmented elements 124 radially outward when the outer tubular sleeve 116 is moved rearwardly relative to the inner tubular sleeve 114. Preferably, the projections 144 have a chamfered portion 148.

The electrical connector 110 also has a second connector portion 150 that is to be mated with the first connector portion 112. The second connector portion 150 has a chamfered front portion 152 that extends to a rearward facing surface 154, the second connector portion 150 being configured to fit with in the distal portion 118 of the inner tubular sleeve 114. The projections 126, and more particularly the rearward facing surfaces 128, on the at least two segmented elements 124 engage the rearward facing surface 154 when the first connector portion 112 is made with the second connector portion 150.

The electrical connector 110 also includes in the inner tubular sleeve 114 a central contact 160 surrounded by a dielectric 162. Central contact 160 is in physical and electrical communication with a center contact 164 in the second connector portion 150. The central contact 160 has a front end 166 that is aligned with the forward facing surface 130 on the interior portion 132 of the inner tubular sleeve 114. As a result, at least a portion of the center contact 164 extends beyond a front end 168 of the second connector portion 150 to engage the central contact 160.

To disengage the first connector portion 112 from the second connector portion 150, a user pulls backward on the outer tubular sleeve 116, causing the projections 144 to move between the projections 126 on the at least two segmented elements 124 and the second connector portion 150 and lifting at least two segmented elements 124 in a radially outward direction, allowing the first connector portion 112 to be unmated from the second connector portion 150.

Figure 10:
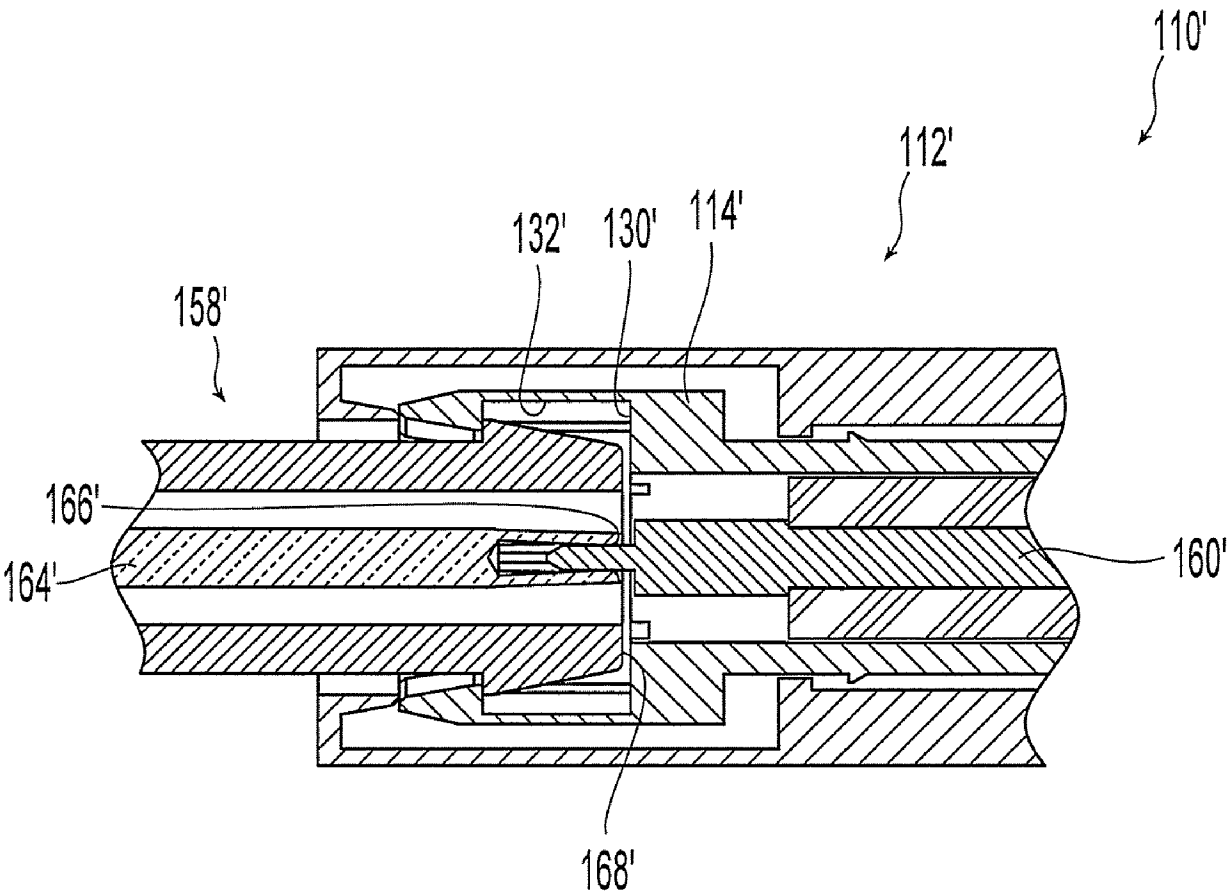
FIG. 10 is a cross sectional view of another embodiment of an electrical connector according to the present invention prior to engagement.

An alternative embodiment of an electrical connector 110' is illustrated in FIG. 10. In electrical connector 110', the central contact 160' extends beyond the forward facing surface 130' of the interior portion 132' of the inner tubular sleeve 114', making the first connector portion 112' the male portion. The center contact 164' in the second connector portion 150' has a front end 166' that is approximately equal with the front end 168' of the second connector portion 150'.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An electrical connector for mounting on an end of a coaxial cable comprising:

a tubular sleeve configured to be mounted to a coaxial cable, the tubular sleeve comprising:

a front end, a back end, and a middle portion, at least two spring fingers extending between the front end and the middle portion and having outwardly extending projections at the front end thereof; and a forward facing shoulder disposed between the back end and the middle portion;

an outer tubular housing slidingly disposed over the tubular sleeve, the outer tubular housing having a first distal portion having a first diameter and a second proximal portion having a second diameter, the first diameter being smaller than the second diameter, the outer tubular housing extending beyond the front end of the tubular sleeve;

at least two openings disposed in the first distal portion to receive the projections from the at least two spring fingers, the at least two openings disposed a predetermined distance from a front end thereof; and a resilient member disposed around the tubular sleeve, a first portion engaging the forward facing shoulder and a second portion engaging a rearward facing surface on an interior surface of the outer tubular housing to bias the outer tubular housing in a forward direction relative to the tubular sleeve.

2. The electrical connector according to claim 1, wherein sliding the outer tubular housing rearwardly causes the projections to be pushed inwardly and out of the openings by a forward portion of the outer tubular housing.

3. The electrical connector according to claim 1, wherein the front end of the tubular sleeve is rearward of the front end of the outer tubular housing when the outer sleeve is biased in a forward position.

4. The electrical connector according to claim 1, further comprising a washer disposed between the resilient member and the rearward facing surface on the interior surface of the outer tubular housing.

5. The electrical connector according to claim 1, further comprising a center contact and a dielectric disposed around the center contact, the center contact and dielectric being disposed in the tubular sleeve and a front end of the center contact extends forward of the outer tubular housing.

6. The electrical connector according to claim 1, further comprising a center contact and a dielectric disposed around the center contact, the center contact and dielectric being disposed in the tubular sleeve and a front end of the center contact extends forward of the tubular sleeve and proximal of a forward end of the outer tubular housing.

7. An electrical connector comprising:

a first connector portion comprising:

an inner tubular sleeve having a distal portion, a medial portion, and a proximal portion, the distal portion having at least two segmented elements, the at least two segmented elements each having a projection extending radially inward and having a rearward facing surface, the medial portion having a forward facing surface on an interior portion of the inner tubular sleeve and a rearward facing surface on an external portion of the inner tubular sleeve, and an outer tubular sleeve slidingly disposed over the inner tubular sleeve and having a distal portion and a proximal portion, the proximal portion disposed over the proximal portion of the inner tubular sleeve and having a first internal diameter, and the distal portion disposed over the distal and medial portions of the inner tubular sleeve and having a second internal diameter that is greater than the first internal diameter, the distal portion having an inward and backward extending projection at a front end to engage and force the at least two segmented elements radially outward when the outer tubular sleeve is moved rearwardly relative to the inner tubular sleeve; and a second connector portion to be mated with the first connector portion, the second connector portion having a chamfered front portion extending to a rearward facing surface and configured to fit within the distal portion of the inner tubular sleeve, the projections on the at least two segmented elements engaging the rearward facing surface of the second connector portion when mated therewith.

8. The electrical connector according to claim 7, further comprising a center contact and a dielectric disposed around the center contact, the center contact and dielectric being disposed in the inner tubular sleeve and a front end of the center contact being aligned with the forward facing surface on the interior portion of the inner tubular sleeve.

9. The electrical connector according to claim 7, wherein both projections have chamfered portions and the chamfered portions make contact with one another as the outer tubular sleeve is moved rearwardly relative to the inner tubular sleeve.

10. The electrical connector according to claim 7, further comprising a center contact and a dielectric disposed around the center contact, the center contact and dielectric being disposed in the inner tubular sleeve and a front end of the center contact extends forward of the forward facing surface on the interior portion of the inner tubular sleeve.

* * * * *